US008339042B2

(12) United States Patent
Park et al.

(10) Patent No.: US 8,339,042 B2
(45) Date of Patent: Dec. 25, 2012

(54) PROTECTIVE LAYER FOR PLASMA DISPLAY PANEL, AND RELATED TECHNOLOGIES

(75) Inventors: Minsoo Park, Seoul (KR); Youngsung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 469 days.

(21) Appl. No.: 12/191,051

(22) Filed: Aug. 13, 2008

(65) Prior Publication Data

US 2009/0045744 A1 Feb. 19, 2009

(30) Foreign Application Priority Data

Aug. 14, 2007 (KR) ..... 10-2007-0081882

(51) Int. Cl.
*H01J 17/49* (2006.01)

(52) U.S. Cl. ..... 313/587

(58) Field of Classification Search ..... 313/587, 313/582–586
See application file for complete search history.

(56) References Cited

U.S. PATENT DOCUMENTS

| | | | | |
|---|---|---|---|---|
| 5,770,921 | A * | 6/1998 | Aoki et al. | 313/581 |
| 6,150,030 | A * | 11/2000 | Stollenwerk et al. | 428/432 |
| 6,744,201 | B2 | 6/2004 | Nakayama et al. | |
| 6,761,608 | B2 * | 7/2004 | Tanaka et al. | 445/25 |
| 6,788,373 | B2 * | 9/2004 | Ito et al. | 349/122 |
| 7,161,297 | B2 | 1/2007 | Kotera et al. | |
| 2002/0047816 | A1 * | 4/2002 | Kajiyama et al. | 345/41 |
| 2002/0121861 | A1 * | 9/2002 | Katou et al. | 313/587 |
| 2004/0056594 | A1 * | 3/2004 | Kotera et al. | 313/582 |
| 2004/0130267 | A1 | 7/2004 | Kajiyama et al. | |
| 2005/0088095 | A1 * | 4/2005 | Kim | 313/586 |
| 2007/0126361 | A1 * | 6/2007 | Lee | 313/586 |

FOREIGN PATENT DOCUMENTS

JP 2006318826 A 11/2006

OTHER PUBLICATIONS

European Search Report for Application No. 08162371.2-2208/2026371 dated May 21, 2010, 7 pages.

* cited by examiner

*Primary Examiner* — Nimeshkumar Patel
*Assistant Examiner* — Steven Horikoshi
(74) *Attorney, Agent, or Firm* — Fish & Richardson P.C.

(57) ABSTRACT

A surface of an MgO protective layer for a plasma display panel (PDP) comprises a combination of a crystalline structure (111) and a crystalline structure (200). The MgO protective layer can exhibit improved discharge time lag (jitter) and sputtering resistance characteristics.

4 Claims, 9 Drawing Sheets

PROTECTIVE LAYER FOR PLASMA DISPLAY PANEL, AND RELATED TECHNOLOGIES

This application claims priority under 35 U.S.C. §119(a) from Korean Patent Application No. 10-2007-0081882, filed Aug. 14, 2007 in the Korean Intellectual Property Office, the entirety of which is incorporated by reference herein.

BACKGROUND

1. Field

This disclosure relates to a plasma display panel (PDP) and to a protective layer and an upper panel of a PDP having the same.

2. Description of the Related Art

In general, a PDP is constructed such that an upper panel and a lower panel are combined with a certain gap therebetween and phosphors are disposed within discharge cells divided by barrier ribs disposed between the upper and lower panels. The upper panel can comprise a substrate, scan electrodes, sustain electrodes, a dielectric layer, and a protective layer formed of MgO (magnesium oxide). The lower panel can comprise a substrate, address electrodes and a dielectric layer. In the PDP, when drive signals are supplied to the electrodes by a driver, phosphors formed within the discharge cells are excited, emitting light.

Magnesium (Mg) has a high electron affinity, which enables it to bond with other ions such as oxygen, and which enables the MgO pair to withstand impact of inert PDP gas during excitation. The MgO protective layer of the upper panel can influence the discharge characteristics when the PDP is driven (operated). In particular, address discharge jitter (time lag) occurring during an address period, and/or discharge voltage characteristics according to a secondary electron emission coefficient, vary depending on surface characteristics of the MgO protective layer. In addition, the MgO protective layer can affect a life span of the PDP according to sputtering resistance characteristics of the layer.

SUMMARY

In one general aspect, a plasma display panel comprises: a first panel having a substrate with an image display surface; scan electrodes and sustain electrodes arranged in parallel to a portion of the substrate; a dielectric layer disposed at the substrate to cover the scan electrodes and the sustain electrodes; and an MgO protective layer disposed at a portion of the dielectric layer. The MgO protective layer has a surface that includes a combination of a crystalline structure (111) and a crystalline structure (200).

Implementations can include one or more of the following features. For example, the combination can further comprise a crystalline structure (220). In some implementations, the combination includes the crystalline structure (220) in a first amount, the crystalline structure (111) in a second amount, and the crystalline structure (200) in a third amount, the first amount being less than the second amount and the third amount.

In some examples, the combination can include more of the crystalline structure (111) than the crystalline structure (200). In some examples, the combination can include more of the crystalline structure (200) orientation than the crystalline structure (111). The MgO protective layer can comprise a single crystal or polycrystalline structure.

The MgO protective layer can includes columnar crystals arranged on a substrate in first and second columnar crystal groups. A first slope between a columnar portion of the first columnar crystal group and a surface of the substrate can be larger than a second slope between a columnar portion of the second columnar crystal group and the surface of the substrate. The second slope can be within the range of 1° to 45.° In some implementations, the second slope can be within the range of 10° to 20°. The MgO protective layer can further comprise a single crystal or polycrystalline structure.

The columnar crystals can be further arranged in a third columnar crystal group. A third slope between a columnar portion of the third columnar crystal group and the surface of the substrate can be substantially the same or larger than the second slope and smaller than the first slope. A crystal orientation surface of the third columnar crystal group can include a crystalline structure (220).

The plasma display panel can further comprise: a second panel parallel to the first panel, the second panel having a second substrate; address electrodes disposed on the second substrate and disposed between the first and the second panels; barrier ribs disposed between the first and the second panels; and a second dielectric layer disposed between the first and the second panels to cover the address electrodes. The MgO protective layer can be disposed between the second panel and the dielectric layer that covers the scan electrodes and the sustain electrodes.

In another general aspect, a plasma display panel comprises: a first panel having a substrate with an image display surface; scan electrodes and sustain electrodes arranged in parallel to a portion of the substrate; a dielectric layer disposed at the substrate to cover the scan electrodes and the sustain electrodes; and an MgO protective layer disposed at a portion of the dielectric layer. The MgO protective layer has a surface that includes a combination of crystalline structures (111) and (200) that resulted from a process configured to grow the MgO protective layer with a combination of crystalline structures (111) and (200).

Implementations can include one or more of the following features. For example, the combination can further comprise a crystalline structure (220). The combination can include the crystalline structure (220) in a first amount, the crystalline structure (111) in a second amount, and the crystalline structure (200) in a third amount, the first amount being less than the second amount and the third amount.

In some examples, the combination can include more of the crystalline structure (111) than the crystalline structure (200). In some examples, the combination can include more of the crystalline structure (200) orientation than the crystalline structure (111). The MgO protective layer can comprise a single crystal or polycrystalline structure.

In yet another general aspect, a method of forming a protective layer of a plasma display panel is provided. The method comprises positioning MgO material within a crucible; mounting a substrate in a chamber, the substrate having electrodes and a dielectric layer formed thereon; exhausting the chamber to maintain a vacuum state; applying a voltage to the chamber at a rate of 6 A/sec; heating the MgO material in the crucible at a temperature of 300 degrees Celsius such that the MgO material evaporates to coat a portion of the dielectric layer of the substrate; and during the heating, applying oxygen at a flow rate of 10 sccm to form an MgO protective layer having a surface that includes a combination of a crystalline structure (111) and a crystalline structure (200).

Other features and advantages will be apparent from the following description and the claims.

DETAILED DESCRIPTION

Implementations consistent with this disclosure can provide a protective layer that includes a surface having a mixed crystalline structure, resulting in improved film characteristics and allowing a PDP to operate in an optimal state. In at least one implementation, a crystal orientation (alignment) surface of an MgO protective layer of a plasma display panel (PDP) can include a mixture of a surface having a (111) orientation and a surface having a (200) orientation. In some examples, the crystal orientation surface of the MgO protective layer further comprises a (220)-oriented surface.

Figure 1:
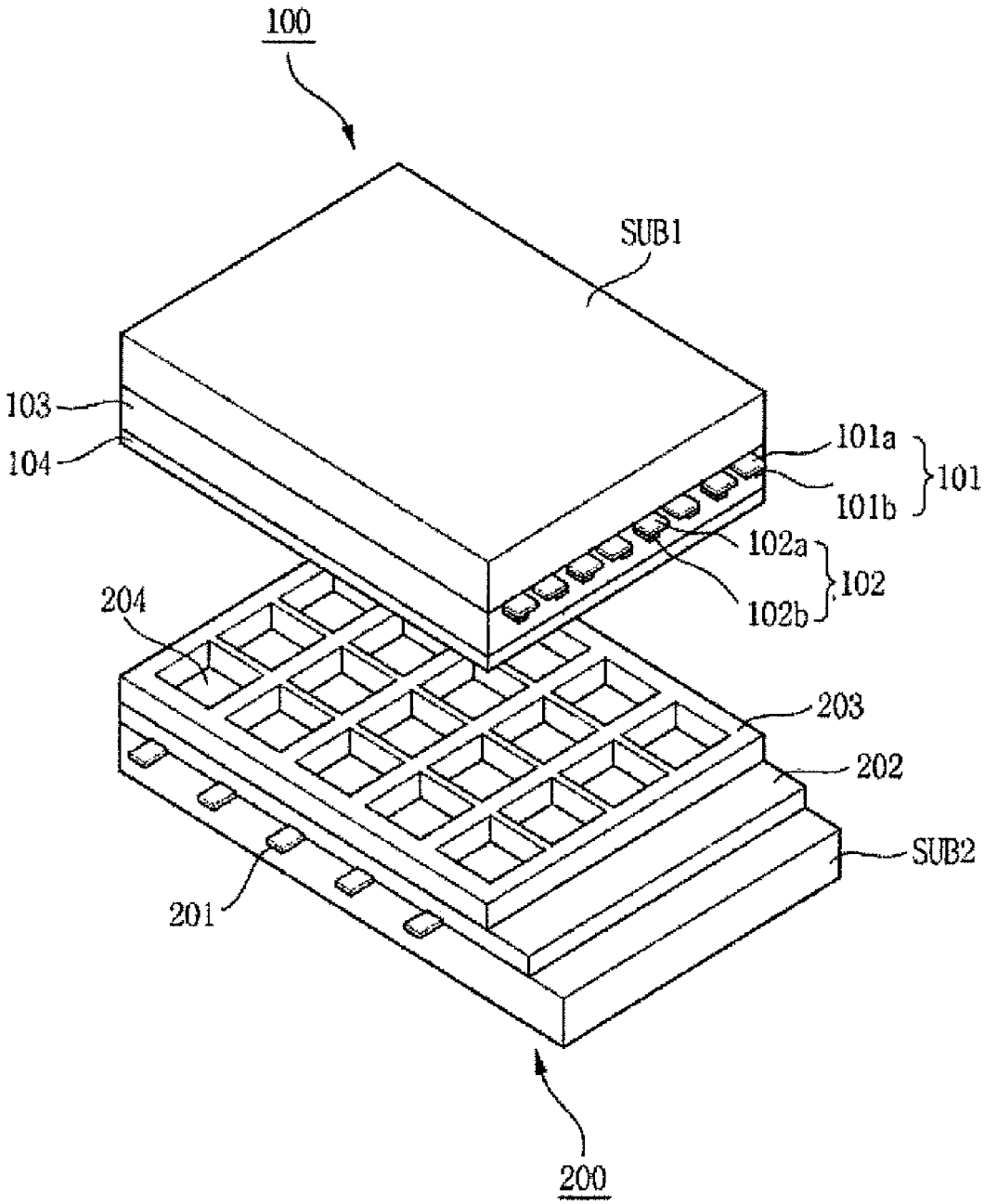
FIG. 1 is a perspective view showing an example PDP.

FIG. 1 is a perspective view illustrating an example implementation of a PDP. As shown in FIG. 1, the PDP includes a first panel 100 and a second panel 200. The first panel 100 comprises a first substrate SUB 1, scan electrodes 101, sustain electrodes 102, a first dielectric layer 103, and a protective layer 104.

The scan electrodes 101 and the sustain electrodes 102 are disposed such that they are parallel on the first substrate SUB1. The electrodes can be arranged to be parallel at certain intervals at an upper portion of the substrate. The scan electrodes 101 and the sustain electrodes 102 include transparent electrodes 101*a* and 102*a* and bus electrodes 101*b* and 102*b*, respectively. The transparent electrodes 101*a* and 102*a* are made of ITO (indium-tin-oxide) and spread discharging when a driving voltage is applied thereto. The bus electrodes 101*b* and 102*b* are made of a metal with low resistance.

The first dielectric layer 103 covers the scan electrodes 101 and the sustain electrodes 102 to insulate them from each other. Although not shown in FIG. 1, the dielectric layer 103 can be formed as multiple layers, each dielectric layer having a different dielectric constant to improve discharge characteristics.

The protective layer 104 is positioned on the first dielectric layer 103 and can be made of a suitable material, such as MgO. The protective layer 104 emits secondary electrons to facilitate discharge, and it protects the scan electrodes 101, the sustain electrodes 102, and the first dielectric layer 103 against sputtering of positive ions. Additional details of the structure and characteristics of the protective layer 104 are described below.

The second panel 200 includes a second substrate SUB2, address electrodes 201, a second dielectric layer 202, barrier ribs 203, and a phosphor layer 204. The address electrodes 201 are disposed on the second substrate SUB2 such that they cross the scan electrodes 101 and the sustain electrodes 102. The second dielectric layer 202 covers and insulates the address electrodes 201. The second dielectric layer 202 can be a white back dielectric layer, which can be used to smoothly reflect light.

The barrier ribs 203 partition the discharge cells corresponding to each crossing of the sustain electrodes 102 and the address electrodes 201. Although the barrier ribs 203 as shown in FIG. 1 have a lattice form, other various forms can be used, such as a stripe form. A suitable discharge gas (e.g., neon (Ne), xenon (Xe), and the like) is filled within the discharge cells.

In the PDP of FIG. 1, address discharges can occur between the electrodes 101 and 201 upon receiving driving voltages from the electrodes 101 and 201, thus forming wall charges in the dielectric layer. Also, sustain discharges occur between the electrodes 101 and 102 by AC (alternating current) signals alternately supplied to the pair of electrodes 101 and 102 of the first panel 100 from discharge cells selected by the address discharges. Accordingly, the discharge gas filled in the discharge space forming the discharge cells is then excited and transitions to generate ultraviolet rays. As the ultraviolet rays are excited, visible rays are generated to implement images.

The MgO protective layer can be fabricated using various processes, such as a sputtering method, an electron beam deposition method, a chemical vapor deposition method, a sol-gel method, an ion plating method, etc. In the electron beam deposition method, electron beams accelerated by an electric field and a magnetic field collide with an MgO deposition material to heat and evaporate the deposition material to thus form the MgO protective layer. The protective layer formed using the sputtering method is dense and can be advantageous for the crystal orientation. The ion plating method can be advantageous in that the deposition can be quickly performed and the protective layer can have desirable adherence and crystalline characteristics.

The MgO protective layer can be fabricated according to the various methods and film characteristics depending on a voltage, a current, a deposition temperature, an oxygen flow and a material purity applied for a protective layer deposition equipment.

Figure 2A:
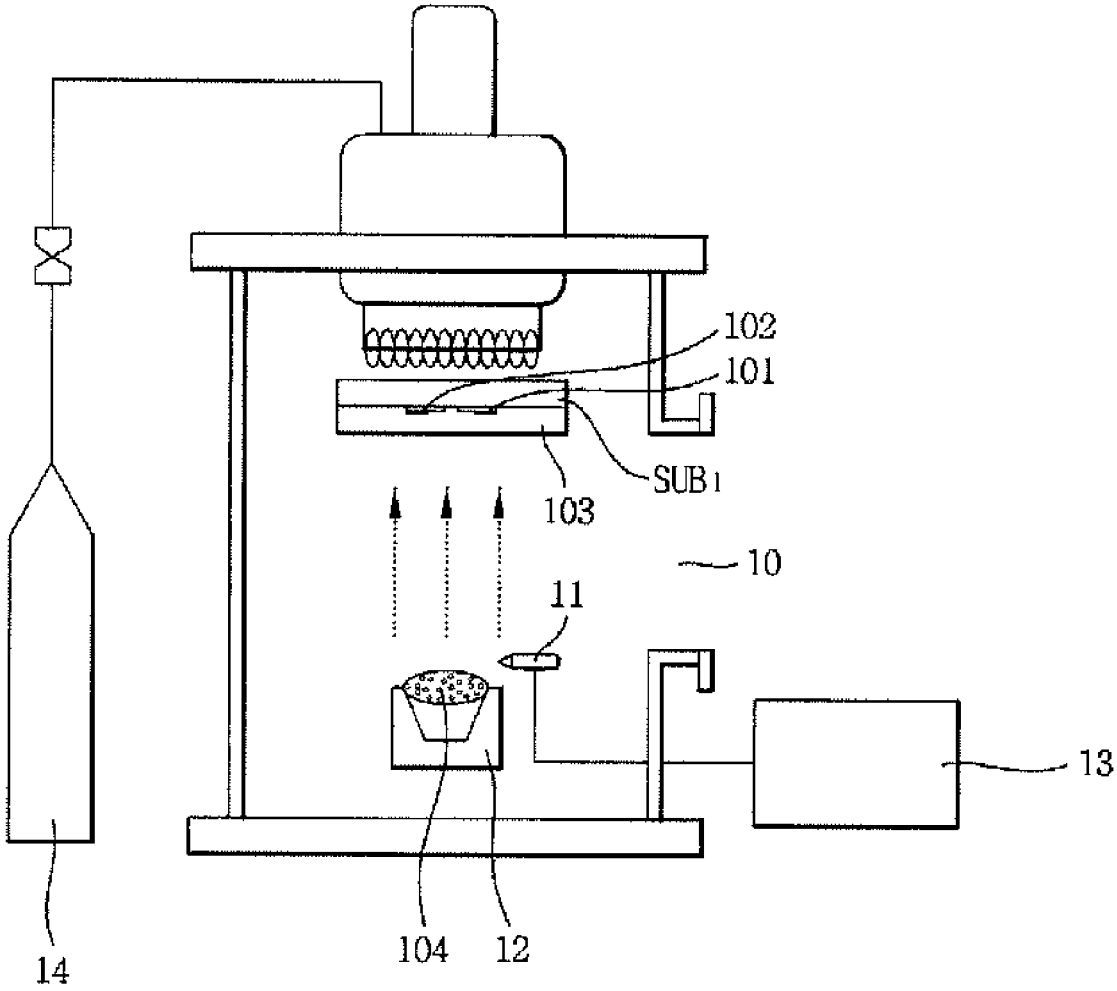
FIG. 2 is a view showing an example process of depositing an MgO protective layer.
Figure 2B:
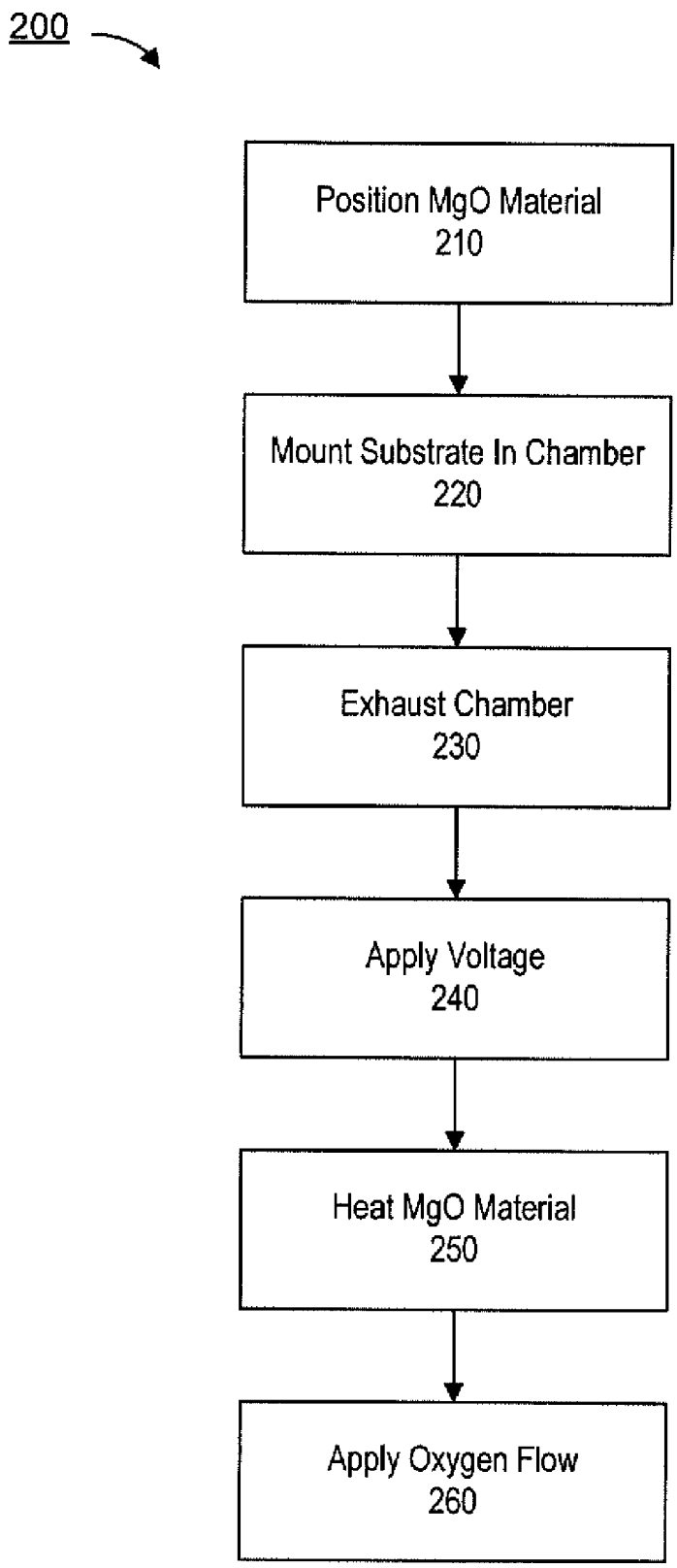

FIG. 2A is a view illustrating an example process of depositing the MgO protective layer on the substrate, according to one example implementation. FIG. 2B is corresponding flowchart showing an example process 200 of forming the MgO protective layer. An MgO material 104 (a raw material of the protective layer) is positioned within a crucible 12 (stage 210). The substrate SUB1 with the electrodes 101 and 102 and the dielectric layer 103 formed thereon is mounted (stage 220) in a chamber 10. Thereafter, the chamber 10 is exhausted (stage 230) to maintain a high vacuum state, into which a voltage is applied (stage 240) through a power supply unit 13. Then, thermal electrons are emitted from an electron gun 11. Such thermal electrons heat (stage 250) the MgO material 104 disposed in the crucible 12 to evaporate the same so as to be coated on an upper portion of the dielectric layer 103 of the substrate. At this time, an oxygen supply unit 14 controls an oxygen flow (stage 260) to improve film characteristics (e.g., discharge time lag characteristics, sputtering resistance, and discharge voltage characteristics, etc.) by controlling the crystal orientation surface of the MgO protective layer.

In experiments, oxygen ($O_2$) of the MgO protective layer was changed to measure a change in the crystal orientation surface and an experiment of the film characteristics according to the crystal orientation surface was carried out. Table 1 below shows the crystal orientation surface of the MgO protective layer according to an oxygen flow and the discharge time lag (jitter) characteristics according to the crystal orientation surface.

TABLE 1

| | Crystal orientation surface | Discharge time lag (Tf) | Discharge voltage characteristics (Vzy) |
|---|---|---|---|
| 1 | (111) | 0.74~0.76 sec | 286~290 V |
| 2 | (111) & (200) | 0.67~0.68 sec | 284~290 V |
| 3 | (111) & (200) & (220) | 0.77~0.78 sec | 264~265 V |
| 4 | (111) & (222) | 0.73~0.75 sec | 288~290 V |

As noted in Table 1, the MgO protective layer exhibits the lowest discharge time lag when the crystal orientation surface is formed with a mixture of a surface having a (111) orientation and a surface having a (200) orientation. As for the discharge voltage characteristics, when the crystal orientation surface is formed with the mixture of the crystalline structure (111), the crystalline structure (200), and the crystalline structure (220), it has better discharge voltage characteristics compared with the case when the crystal orientation surface is formed with the mixture of only the crystalline structure (111) and the crystalline structure (200).

Figure 6A:
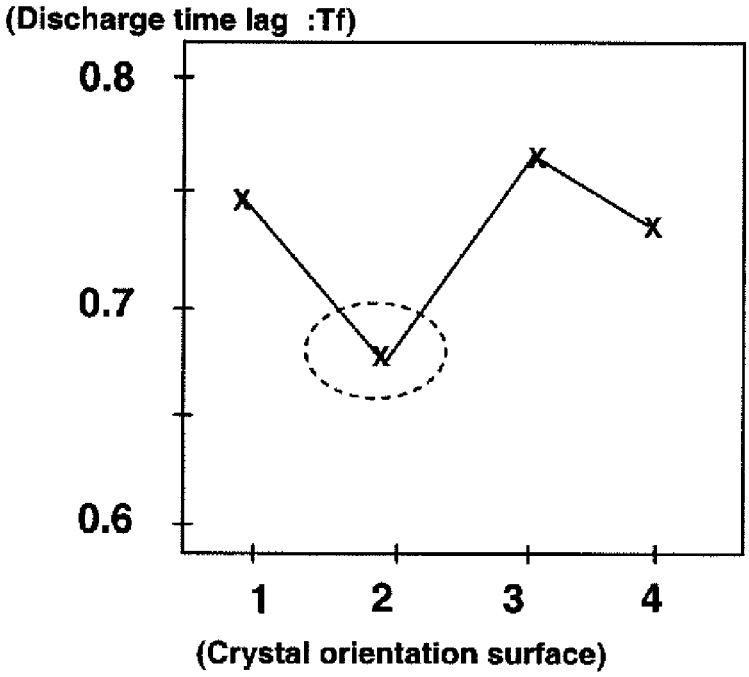
FIG. 6A is a graph showing example discharge time lag characteristics of a crystal orientation surface.

FIG. 6A is a graph showing discharge time lag characteristics of a crystal orientation surface, corresponding to the experimental results. As shown in the graph, the lowest discharge time lag (0.67~0.68 sec) occurs for the crystal orientation surface (2): when the crystal orientation surface is formed with a combination of a crystalline structure (111) and a crystalline structure (200).

Figure 6B:
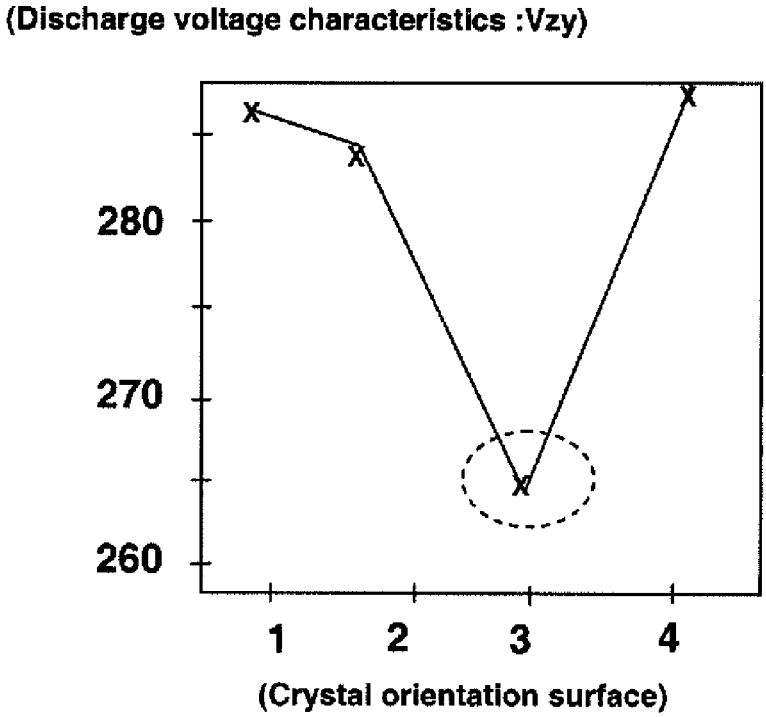
FIG. 6B is a graph showing example discharge voltage characteristics of a crystal orientation surface.

FIG. 6B is a graph showing discharge voltage characteristics of a crystal orientation surface, corresponding to the experimental results. As shown in the graph, the crystal orientation surface (3), which is formed with the mixture of the crystalline structure (111), the crystalline structure (200), and the crystalline structure (220), has better discharge voltage characteristics (264~265 V) compared with the voltage discharge characteristics (284~290 V) of the crystal orientation surface (2), which is formed with the mixture of only the crystalline structure (111) and the crystalline structure (200).

EXAMPLE 1

Table 2 below shows the substantial film characteristics according to a mixture ratio of the crystal orientation surface of the MgO protective layer in one example. As for the experimental conditions, a deposition temperature was maintained at 300° C., the crystal orientation surface was controlled while supplying 0 sccm~5 sccm (flow volume unit) of oxygen to the chamber, and the thickness of the protective layer was 700 nm.

TABLE 2

| Mixture relationship of crystal orientation surface | Discharge time lag characteristics (□: good; ○: normal) | Sputtering resistance characteristics (□: good; ○: normal) |
|---|---|---|
| (111) > (200) | □ | ○ |
| (111) < (200) | ○ | □ |

As noted in Table 2, in the MgO protective layer, when the crystal orientation surface has more of the surface having a (111) orientation than the surface having a (200) orientation, it has better discharge time lag characteristics than the sputtering resistance characteristics. When the crystal orientation surface has more surface (200) than the surface (111), it has better sputtering resistance characteristics than the discharge time lag characteristics.

Figure 3A:
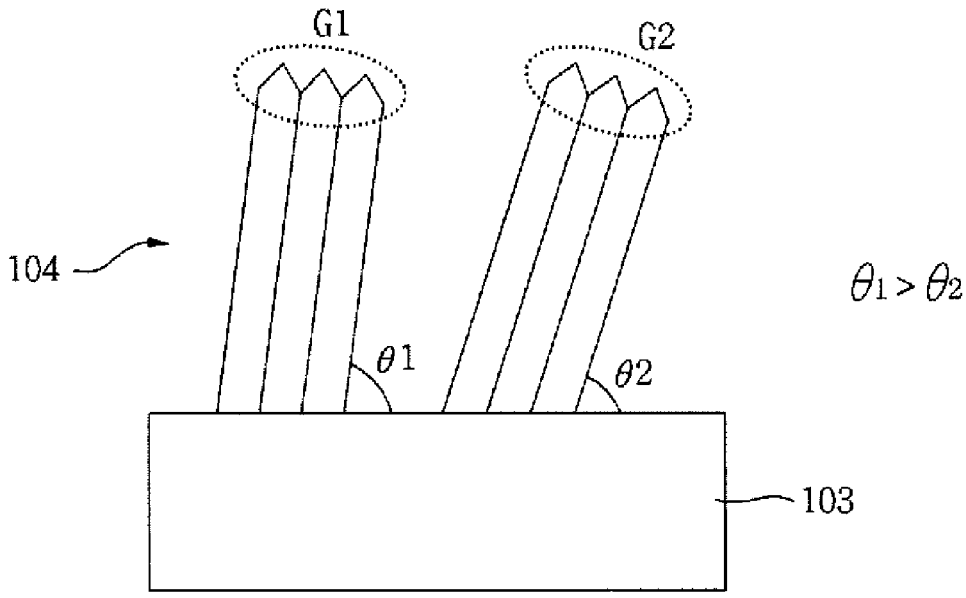
FIG. 3A is a sectional view showing a crystal structure of an MgO protective layer in one example.
Figure 3B:
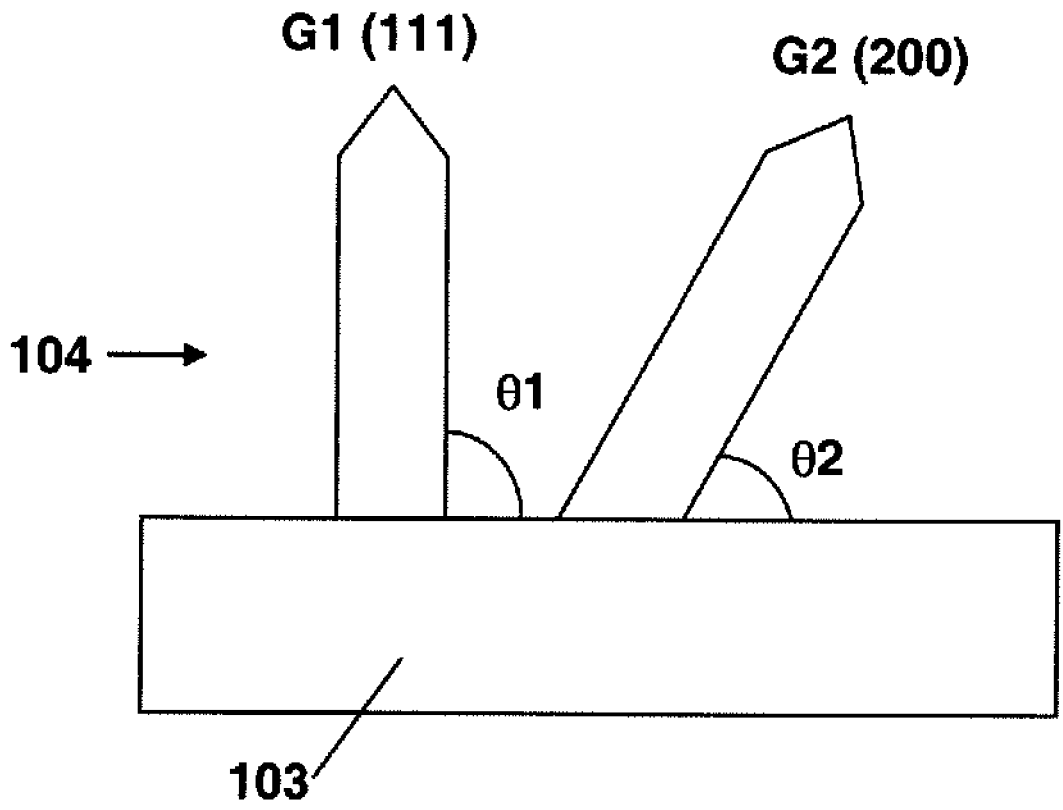
FIG. 3B is a diagram showing a singe crystal growth in each of the (111) and (200) orientations.

FIG. 3A is a sectional view showing the crystal structure of the MgO protective layer obtained in the Example 1 discussed above. With reference to FIG. 3A, in the section of the MgO protective layer that is seen, a plurality of columnar crystals are grouped and aligned at the upper portion of the substrate. Namely, the plurality of columnar crystals include a first columnar crystal group G1 with the crystal orientation surface (111) and a second columnar crystal group G2 with the crystal orientation surface (200). FIG. 3B is a diagram showing a singe crystal growth in each of the (111) and (200) orientations.

Assuming that the slope between the columnar portion of the first columnar crystal group and the surface of the substrate is a first slope θ1 and the slope between the columnar portion of the second columnar crystal group and the surface of the substrate is θ2, the first slope is larger than the second slope. In this case, the second slope θ2 between the columnar portion of the second columnar crystal group and the surface of the substrate is within the range of 1° to 45°, and preferably, within the range of 10° to 20° to have improved discharge time lag characteristics and sputtering resistance characteristics. Meanwhile, in the above-described substrate structure, the plurality of electrodes are formed on the glass and the dielectric layer is formed at the upper portion of the plurality of electrodes.

Although not shown in FIG. 3A, on the surface of the MgO protective layer, the surface area of the crystals having the orientation surface (200) is larger, while the surface area of the crystals having the orientation surface (111) is relatively smaller than that of the crystals having the orientation surface (200).

EXAMPLE 2

Table 3 below shows discharge voltage characteristics obtained according to a mixture ratio of crystal orientation surface different from that of Table 2. Experimental conditions in Example 2 were the same as those of the Example 1, except that 6 sccm~200 sccm (flow volume unit) of oxygen was supplied to the chamber.

TABLE 3

| Mixture relationship of crystal orientation surface | Discharge voltage characteristics (Vzy) (□: good; ○: normal) |
|---|---|
| (111) ≧ (200) > (220) | □ |
| (111) ≧ (200) < (220) | ○ |

As noted in Table 3 above, when the crystal orientation surface of the MgO protective layer comprises the surfaces (111), (200) and (220), and in this case, when the surface (200) is smaller than the surfaces (111) and (200), it has better discharge voltage characteristics.

Figure 4:
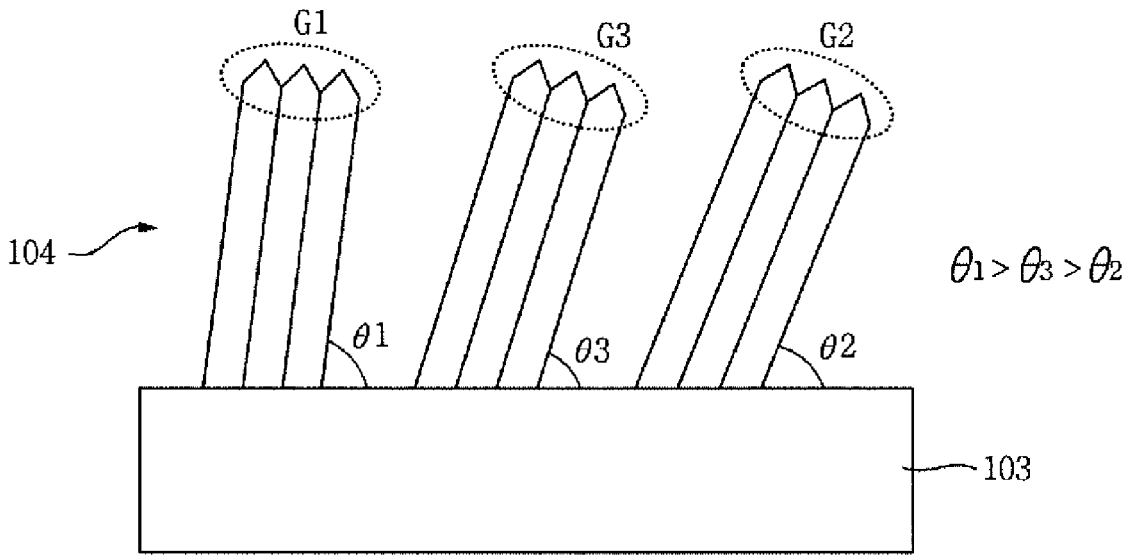
FIG. 4 is a sectional view showing a crystal structure of an MgO protective layer in another example.

FIG. 4 is a sectional view showing the crystal structure of the MgO protective layer obtained in the Example 2.

With reference to FIG. 4, likewise as in the case as shown in FIG. 3, in the section of the MgO protective layer that is seen, a plurality of columnar crystals are grouped and aligned at the upper portion of the substrate. The plurality of columnar crystals include a first columnar crystal group G1 with the crystal orientation surface (111), a second columnar crystal group (G2) with the crystal orientation surface (200), and a third columnar crystal group (G3) with the crystal orientation surface (220). Assuming that the slope between the columnar portion of the first columnar crystal group and the surface of the substrate is a first slope θ1, the slope between the columnar portion of the second columnar crystal group and the surface of the substrate is θ2, and the slope between the columnar portion of the third columnar crystal group and the surface of the substrate is θ3, the third slope is substantially the same as or larger than the second slope, but smaller than the first slope.

In this case, preferably, the third slope θ3 between the columnar portion of the third columnar crystal group and the surface of the substrate is within the range of 10° to 60° in order to improve the discharge voltage characteristics.

Although not shown in the figure, the MgO protective layer includes on its surface crystals having a (220) orientation, making the surface area of the crystals appear uniform overall. But in this case, the surface area is smaller than that of the crystals having the (200) orientation as shown in FIG. 3.

EXAMPLE 3

Table 4 shows the discharge delay time lag and discharge voltage characteristics obtained according to a mixture ratio of the crystal orientation surface of the MgO protective layer. Experimental conditions were the same as those of the experimental Example 1, except that 21 sccm~35 seem (flow volume unit) of oxygen was supplied to the chamber.

TABLE 4

| Mixture relationship of crystal orientation surface | Discharge time lag characteristics (□: good; ○: normal) | Discharge voltage characteristics (□: good; ○: normal) |
|---|---|---|
| (111) > (222) | ○ | ○ |
| (111) < (222) | ○ | ○ |

As noted in Table 4, when the MgO protective layer includes the crystal orientation surfaces (111) and (222), its discharge time lag or discharge voltage characteristics are normal (average).

Figure 5:
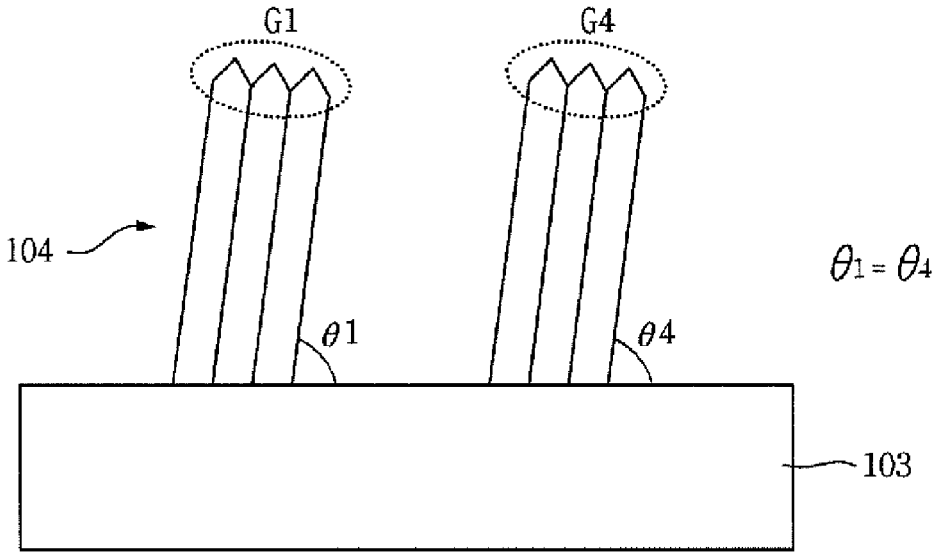
FIG. 5 is a sectional view showing a crystal structure of an MgO protective layer in another example.

FIG. 5 is a sectional view showing the crystal structure of the MgO protective layer obtained in the experimental Example 3. With reference to FIG. 5, likewise as in the case as shown in FIG. 3, in the section of the MgO protective layer that is seen, a plurality of columnar crystals are grouped and aligned at the upper portion of the substrate. The plurality of columnar crystals include a first columnar crystal group G1 with the crystal orientation surface (111) and a fourth columnar crystal group G4 with the crystal orientation surface (222). Assuming that the slope between the columnar portion of the first columnar crystal group and the surface of the substrate is a first slope θ1 and the slope between the columnar portion of the fourth columnar crystal group and the surface of the substrate is θ4, the first slope is substantially the same as the fourth slope.

In this case, the first slope θ1 between the columnar portion of the first columnar crystal group and the surface of the substrate and the fourth slope θ4 between the columnar portion of the fourth columnar crystal group and the surface of the substrate are within the range of 70° to 90°.

Because the MgO protective layer includes on its surface crystals with the (222) orientation, the surface area of the crystals appears to be more uniform overall than that of the crystals as shown in FIG. 4. Also, the surface area of the crystals appears to be smaller than that of the crystals as shown in FIG. 4.

The experimental Examples 1, 2 and 3 indicate that, as the oxygen flow volume unit is reduced in forming the MgO protective layer, the resulting crystal orientation surface can improve film characteristics such as the discharge time lag characteristics, the discharge voltage characteristics and the sputtering resistance. In addition, by spraying MgO powder in a liquefied form onto the MgO protective layer formed according to the above-described experimental examples and thermally treating it, the upper portion of the MgO protective layer can have the single crystal structure or the polycrystalline structure. With such structure, the film characteristics of the MgO protective layer can be further improved.

As discussed above, the MgO protective layer can be fabricated using various processes, such as a sputtering method, an electron beam (E-beam) deposition method, a chemical vapor deposition method, a sol-gel method, an ion plating method, etc. The MgO protective layer can be fabricated according to the various methods and film characteristics depending on a voltage, a current, a deposition temperature, an oxygen flow and a material purity applied for a protective layer deposition equipment.

Figure 7A:
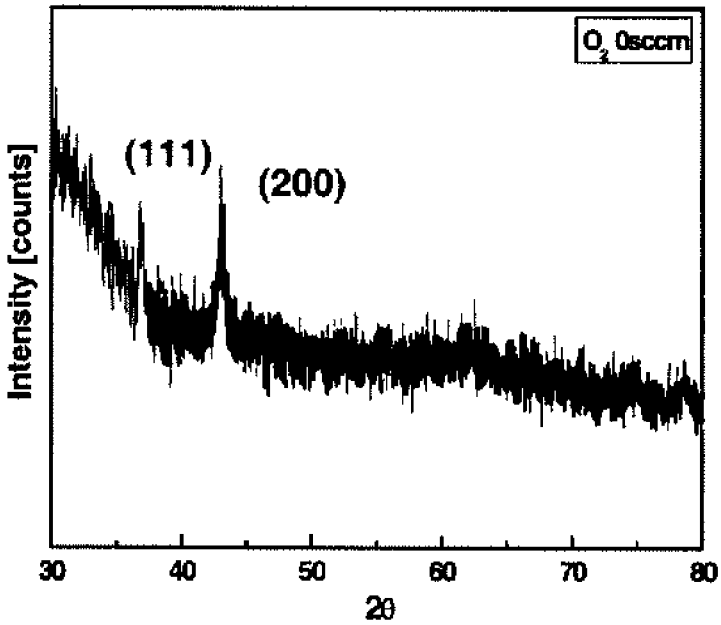
FIGS. 7A, 7B and 7C are graphs showing surface characteristics of an MgO film formed using an example evaporation method.
Figure 7B:
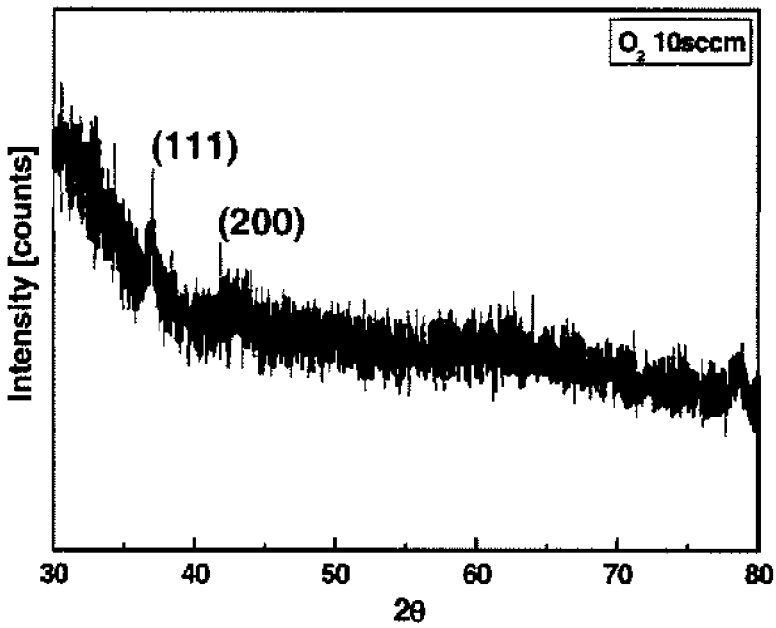
Figure 7C:
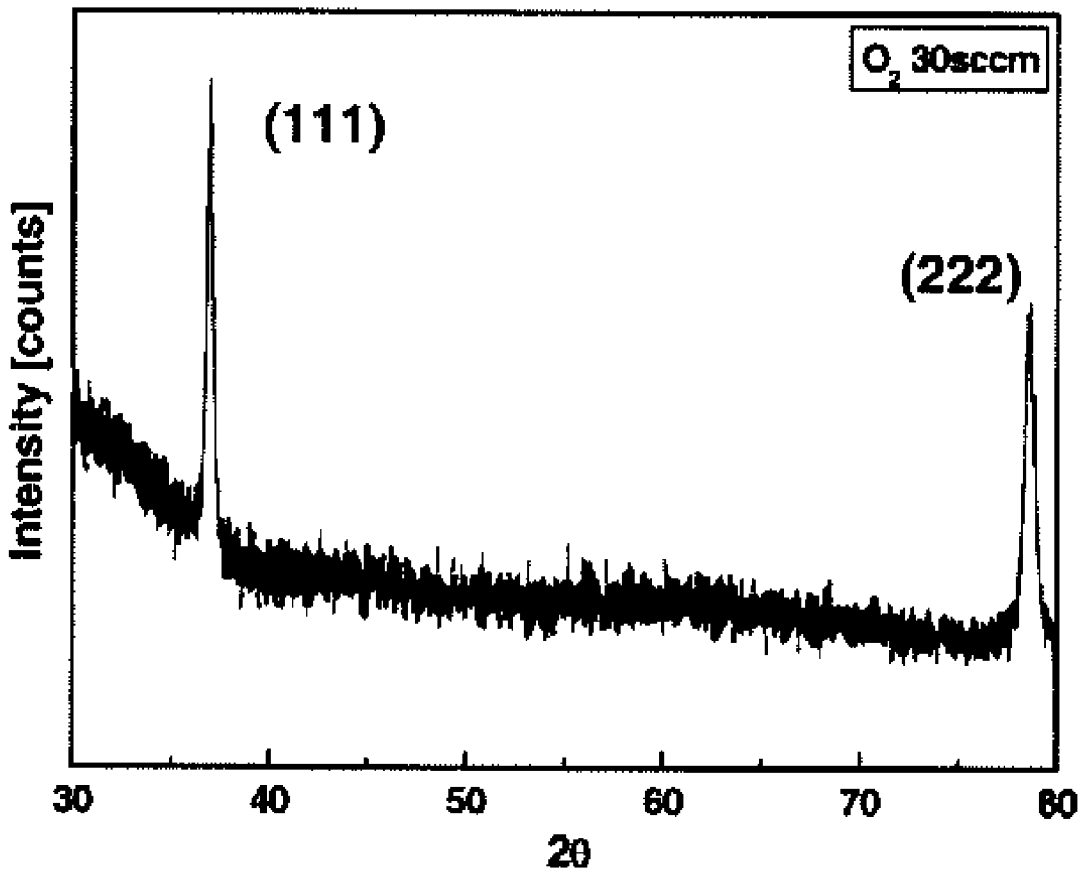

FIGS. 7A, 7B and 7C are graphs showing surface characteristics of an MgO film formed using an example evaporation method. In particular, under the same condition in which an MgO target was used and an MgO film having a target thickness of 700 nm was formed using an E-beam evaporation method with the rate of 6 A/sec at a temperature of 300 degrees Celsius, characteristics of respective MgO films were compared when the flow rates of $O_2$ were 0 sccm (FIG. 7A), 10 sccm (FIG. 7B) and 30 sccm (FIG. 7C).

As shown in FIGS. 7A-7C, the surface characteristics of the formed films substantially change according to the flow rates of oxygen. When the flow rate of $O_2$ was 0 sccm (FIG. 7A), a film having very large surface grain size and which had a strong characteristic of (200) crystal face was formed. When the flow rate of $O_2$ was 30 sccm (FIG. 7C), a film whose grain size of the surface was very small and which had a strong characteristic of (111) crystal face was formed. When the flow rate of $O_2$ was 10 sccm (FIG. 7B), a film having an approximate intermediate grain size characteristic between the above-mentioned two films, and having amorphous properties and therefore a mixed characteristic of (111), (200) crystal faces, was formed.

Although the foregoing description refers to an MgO protective layer, it is contemplated that aspects of this disclosure can apply to other types of protective layers. For example, in some implementations, aspects of the disclosure can be applied to a protective layer that includes a material other than MgO, whether instead of MgO or in addition to MgO (e.g., as a dopant).

The foregoing implementations and advantages are merely examples and are not to be construed as limiting or restricting the scope of this disclosure. Aspects of this disclosure can be readily applied to other types of apparatus. The description of the foregoing implementations is intended to be illustrative and not to limit the scope of the claims. Many alternatives, modifications and variations will be apparent to those skilled in the art. Various changes in form and details may be made in the example implementations described and shown, and other implementations are within the scope of the following claims.

What is claimed is:

1. A plasma display panel, comprising:

a first panel having a substrate with an image display surface;

scan electrodes and sustain electrodes arranged in parallel to a portion of the substrate;

a dielectric layer disposed at the substrate to cover the scan electrodes and the sustain electrodes; and an MgO protective layer disposed at a portion of the dielectric layer, the MgO protective layer having a surface that includes a combination of a crystalline orientation structure (111) and a crystalline orientation structure (200), wherein the MgO protective layer includes columnar crystals arranged on a substrate in first columnar crystal group with the crystalline orientation structure (111), second columnar crystal group with the crystalline orientation structure (200) and third columnar crystal group with the crystalline orientation structure (220), wherein the combination includes the crystalline orientation structure (220) in a first amount, the crystalline orientation structure (111) in a second amount, and the crystalline orientation structure (200) in a third amount, the first amount being less than the second amount and the third amount and the second amount equal or larger than the third amount, wherein a third slope angle between a columnar side portion of the third columnar crystal group and a surface of the substrate is equal or larger than a second slope angle between a columnar side portion of the second columnar crystal group and the surface of the substrate, and smaller than a first slope angle between a columnar side portion of the first columnar crystal group and the surface of the substrate.

2. The plasma display panel of claim 1, wherein the second slope is within the range of 1° to 45°.

3. The plasma display panel of claim 2, wherein the second slope is within the range of 10° to 20°.

4. The plasma display panel of claim 1, further comprising:

a second panel parallel to the first panel, the second panel having a second substrate;

address electrodes disposed on the second substrate and disposed between the first and the second panels;

barrier ribs disposed between the first and the second panels; and a second dielectric layer disposed between the first and the second panels to cover the address electrodes, wherein the MgO protective layer is disposed between the second panel and the dielectric layer that covers the scan electrodes and the sustain electrodes.

* * * * *